United States Patent [19]

Murphy et al.

[11] 4,063,989

[45] Dec. 20, 1977

[54] LABELING MACHINE FEED APPARATUS

[75] Inventors: Donald E. Murphy, Haddonfield; Steven J. Roby, Medford, both of N.J.

[73] Assignee: Campbell Soup Company, Camden, N.J.

[21] Appl. No.: 751,615

[22] Filed: Dec. 16, 1976

Related U.S. Application Data

[63] Continuation-in-part of Ser. No. 606,291, Aug. 20, 1975, abandoned.

[51] Int. Cl.[2] ..... B65C 9/04; B65C 9/08; B65H 1/30

[52] U.S. Cl. ..... 156/453; 156/565; 271/159

[58] Field of Search ..... 156/564, 565, 451, 452, 156/453; 271/158, 159

[56] References Cited

U.S. PATENT DOCUMENTS

| | | | |
|---|---|---|---|
| 816,677 | 4/1906 | Murray | 187/68 |
| 2,137,381 | 11/1938 | Blackstone | 156/452 |
| 2,185,947 | 1/1940 | Neer | 156/451 |
| 2,804,303 | 8/1957 | Henthorn | 271/159 |
| 3,440,801 | 4/1969 | Prince et al. | 271/154 |
| 3,784,179 | 1/1974 | Sugiura | 188/315 |

OTHER PUBLICATIONS

David, B. F., "Hopper Stack Elevating" IBM *Technical Disclosure,* vol. 5, No. 1., June 1962, p. 18.

*Primary Examiner*—Douglas J. Drummond
*Attorney, Agent, or Firm*—Paul & Paul

[57] ABSTRACT

A magazine-type label feed mechanism for a two-table labeling machine is disclosed. Labels to be affixed to containers are loaded on and fed by primary and secondary feed mechanisms in such a manner that an operator can continuously replenish the supply of labels while the labeling machine is operating. Fluid drive means control the position of the label-feed tables and provide a relatively-constant feed pressure.

6 Claims, 11 Drawing Figures

Fig. 6
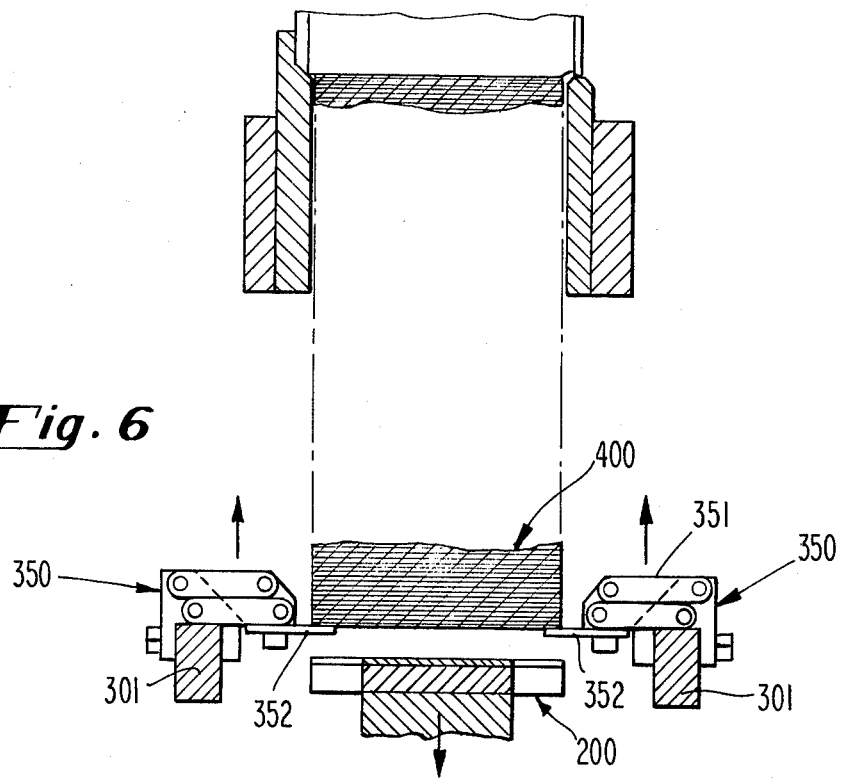
Fig. 7
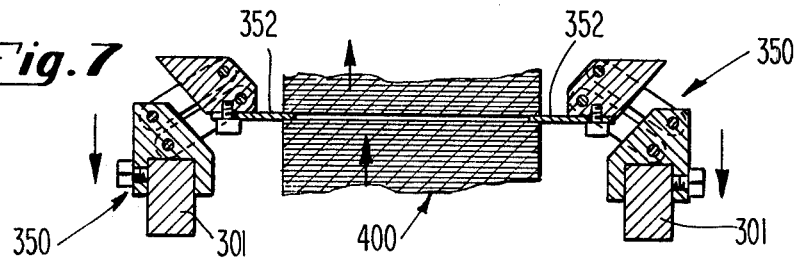
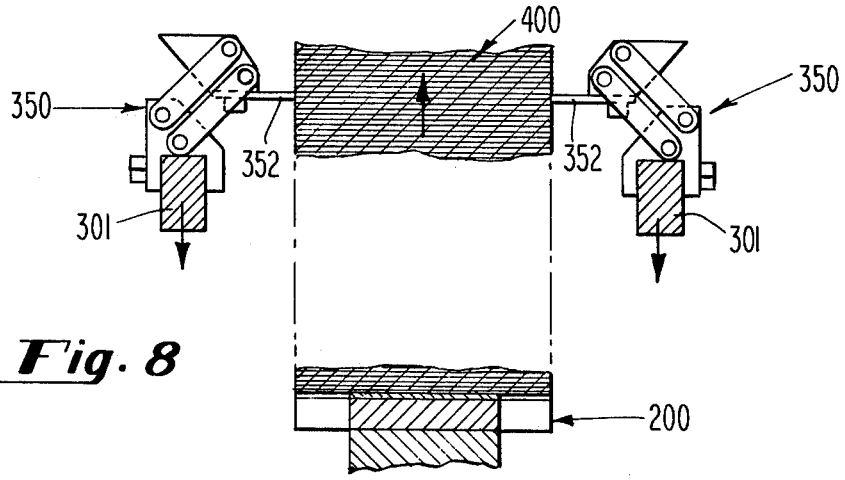
Fig. 8

LABELING MACHINE FEED APPARATUS

CROSS-REFERENCE TO RELATED APPLICATION

This is a continuation-in-part of our pending application, Ser. No. 606,291, filed Aug. 20, 1975 now abandoned.

BACKGROUND OF THE INVENTION

This invention relates to labeling machines, and more particularly to automatic labeling machines which employ primary and secondary feed mechanisms to allow uninterrupted operation of the machine eliminating the need to discontinue operation to replenish the label supply.

Various feed mechanisms have been employed with automatic labeling machines. Roll-type feed machines, which feed labels from a roll rather than a flat stack, are capable of relatively high operational speeds but are quite bulky and complex. Prior art flat pack feed mechanisms are simpler but are limited in speed of operation by the nature of the mechanical controls used to operate the machine. A typical pack feed mechanism for label machines is disclosed in U.S. Pat. No. 2,185,947, issued to Neer. The Neer machine employs primary and secondary tables to feed stack labels. This machine has ratchet and pawl actuators and while it was designed to operate at speeds of up to 1,000 cans per minute, it was limited in practice to a maximum speed of about 700 cans per minute by the mechanical feed mechanism.

In the present invention, the fluid drive means allows operation of a magazine-type labeler at speeds of up to 1,200 cans per minute. Thus, the magazine feed apparatus of this invention is capable of operational speeds almost twice as fast as earlier designs and is smaller than the usual roll-type labeler and less complex than the earlier magazine-type labelers.

SUMMARY OF THE INVENTION

Accordingly, it is among the objects of this invention to provide a new and improved magazine-type feed mechanism for use with two-table flat pack labeling machines which is easy to operate, capable of high speed operation, and less bulky and complicated than earlier magazine-type feed mechanisms.

It is another object of this invention to provide a feed mechanism which can be operated by a relatively unskilled operator with a minimum of training.

It is another object of this invention to provide a label feed mechanism which is easily adjustable to accommodate various label thicknesses without sacrificing high speed operation.

The overall operation of a magazine-type label feed mechanism in accordance with this invention is as follows.

Before initially operating the machine, the primary and secondary feed control tables are lowered to a position where a stack supply of labels can be supported by the primary table. The height of the primary table is then raised so that the topmost label comes into the proper feeding position in the can labeling machine. The secondary table is not supporting any labels during this phase of the operation. During the operation of the can labeling machine, as the stack of labels on the primary table begins to diminish, the operator engages the fingers of the secondary table to hold the existing stack of labels in feed position while at the same time lowering the primary table to allow insertion of a new stack of labels on the primary table. The primary table is then raised back into a position where the top label on the new stack contacts the bottom label on the old stack, at which time the secondary table is lowered automatically withdrawing the fingers. The operation then continues until a new cycle is required.

The raising and lowering of the primary and secondary tables is accomplished by operation of fluid drive means. In one embodiment, the operation of both the primary and secondary tables is accomplished by pueumatic drive means controlled by lever-type pneumatic valves. The excursions of the tables, in this embodiment, are limited by hydraulic damping mechanisms, which insure a smooth, trouble-free operation. In the preferred embodiment, the raising and lowering of the primary and secondary tables is accomplished by a fluid drive mechanism consisting of a pneumatic actuator means and a hydraulic drive means serially connected to each other such that operation of the pneumatic actuator means controls the operation of the hydraulic drive means. The secondary table contains an adjustable spring-biased force-limiting mechanism to filter the application of force applied to the labels by the secondary table.

BRIEF DESCRIPTION OF THE DRAWINGS

FIGS. 6 through 8 illustrate the operation of the fingers of the secondary table.

DESCRIPTION OF THE PREFERRED EMBODIMENT

Figure 1:
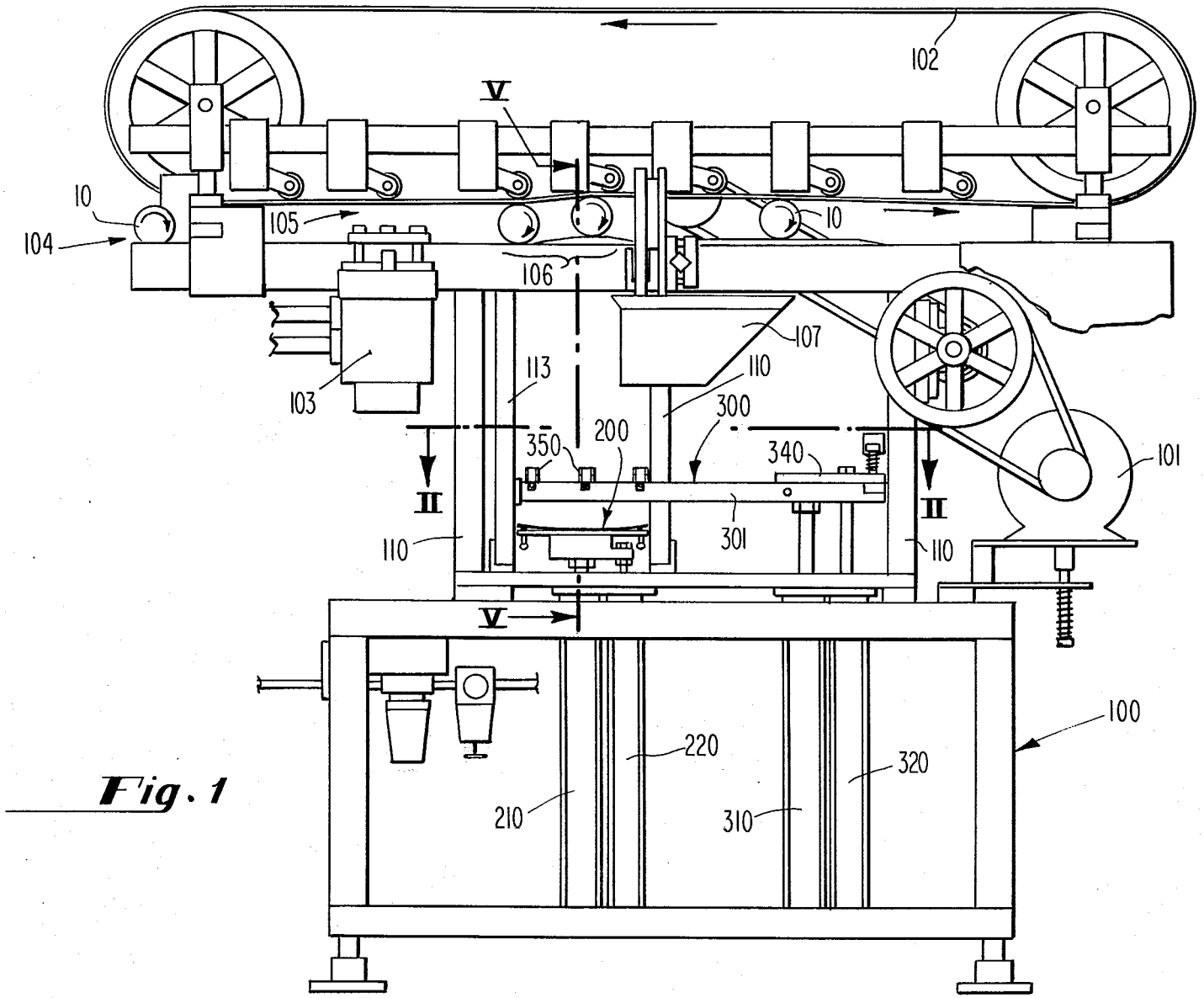
FIG. 1 is an overall view of the can labeling machine.

FIG. 1 gives an overall representation of the operation of the can labeling machine 100. Bright (unlabeled) cans proceed from the entrance 104 of the machine propelled by conveyor belt 102 past an adhesive application zone 105 where adhesive from adhesive container 103 is applied to the periphery of the can. The can then traverses a label application zone, where, as it rotates, the label is affixed to the can. The flat end of each label is provided with a marginal strip of adhesive immediately after leaving the label application zone 106. This second adhesive is contained in container 107 and operates to seal the label to the can. Preferably, the adhesive applied from container 103 is heated glue, while the adhesive applied from container 107 is paste.

The first embodiment of the pack feed mechanism in FIGS. 1–9, operates generally as follows.

Prior to the operation of the machine, primary table 200 and secondary table 300 are lowerd sufficiently to allow insertion of the desired number of labels upon the surface of the primary table. When operation of the labeling machine commences, the primary table 200 is actuated by pneumatic drive means 210 to advance the labels to a position of application to the cans (i.e., label feeding relation). As this initial supply of labels is used up, the secondary table 300, is engaged to feed the remaining stack of labels while the primary table 200 is lowered and a new supply of labels inserted upon it. The primary table 200 is then raised back into position to support the entire stack of labels in the machine. The fingers 350 of the secondary table automatically disengage as secondary table 300 is lowered. The effect of this two-table operation is to continuously supply labels into the proper application position within the machine eliminating the necessity of stopping the machine for replenishment. FIGS. 2 through 9 illustrate the specific mechanisms employed in the first embodiment of the present invention to achieve this operation.

Figure 2:
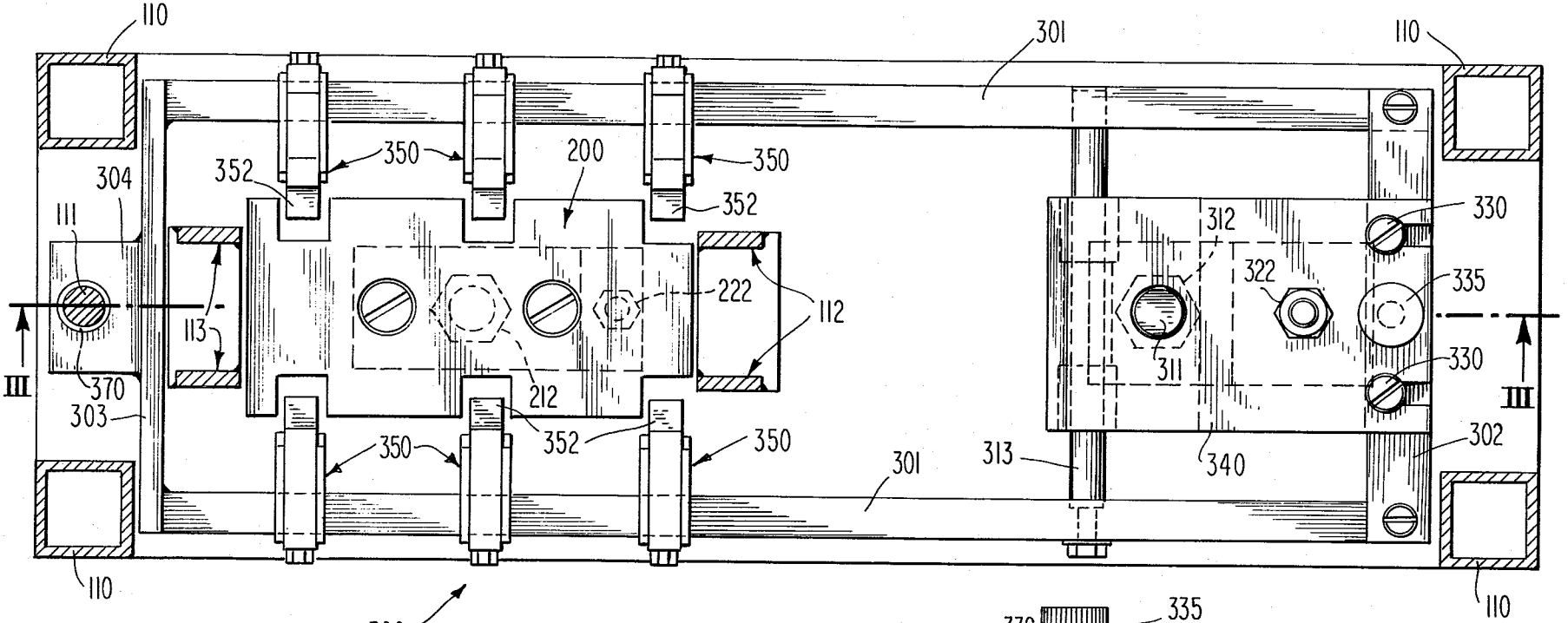
FIG. 2 is a horizontal cross-sectional view taken along line II of FIG. 1, showing details of the primary and secondary feed tables.
Figure 4:
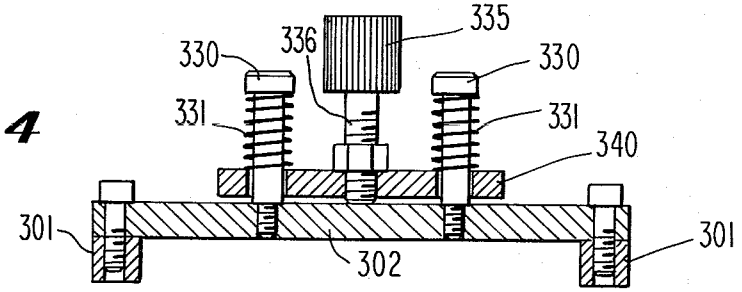
FIG. 4 is a vertical cross-sectional view taken along line IV of FIG. 3, showing details of the secondary table adjustment mechanism.
Figure 3:
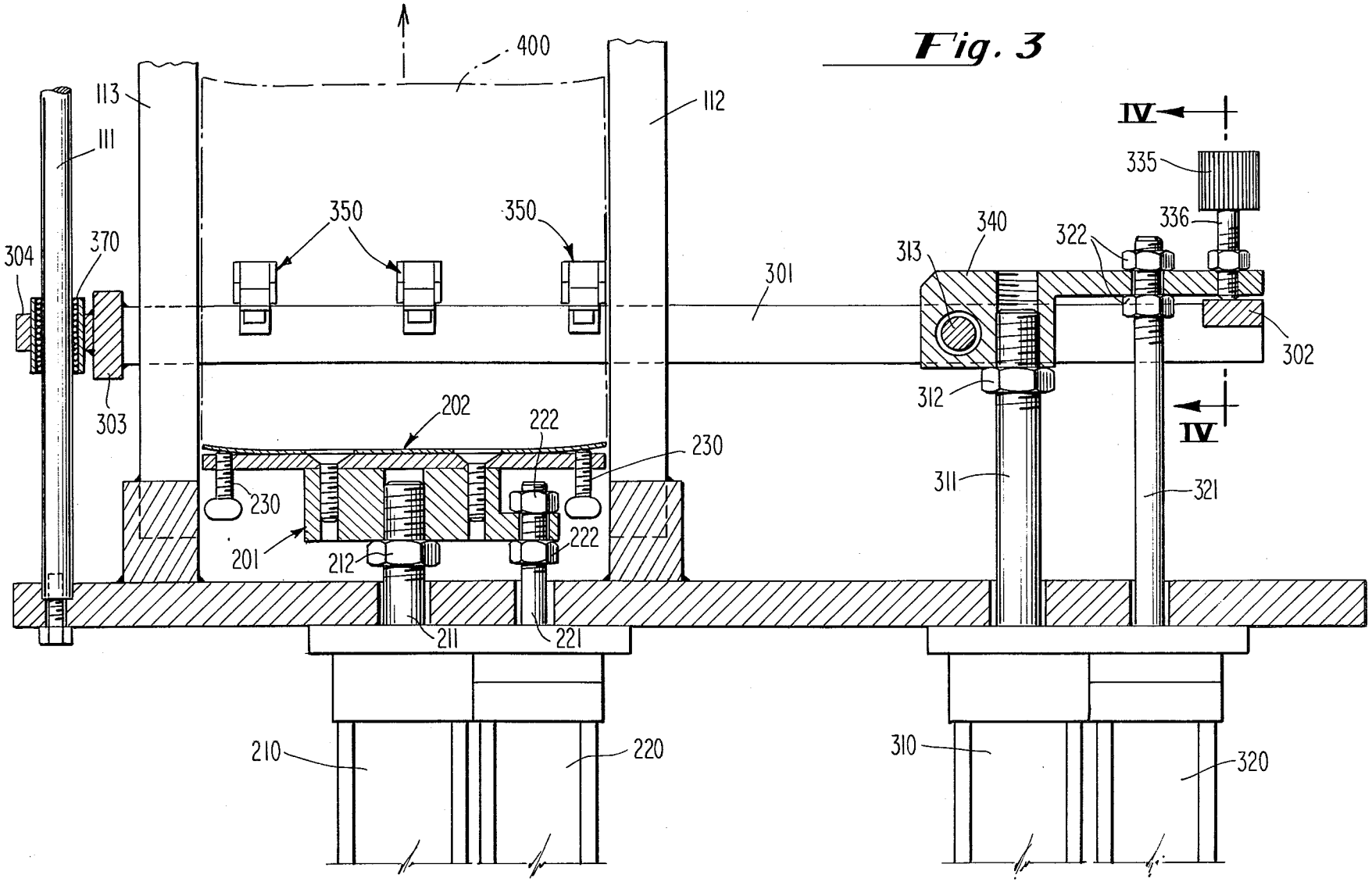
FIG. 3 is a vertical cross-sectional view taken along the line III of FIG. 2, showing details of the primary and secondary table pneumatic/hydraulic actuators.
Figure 5:
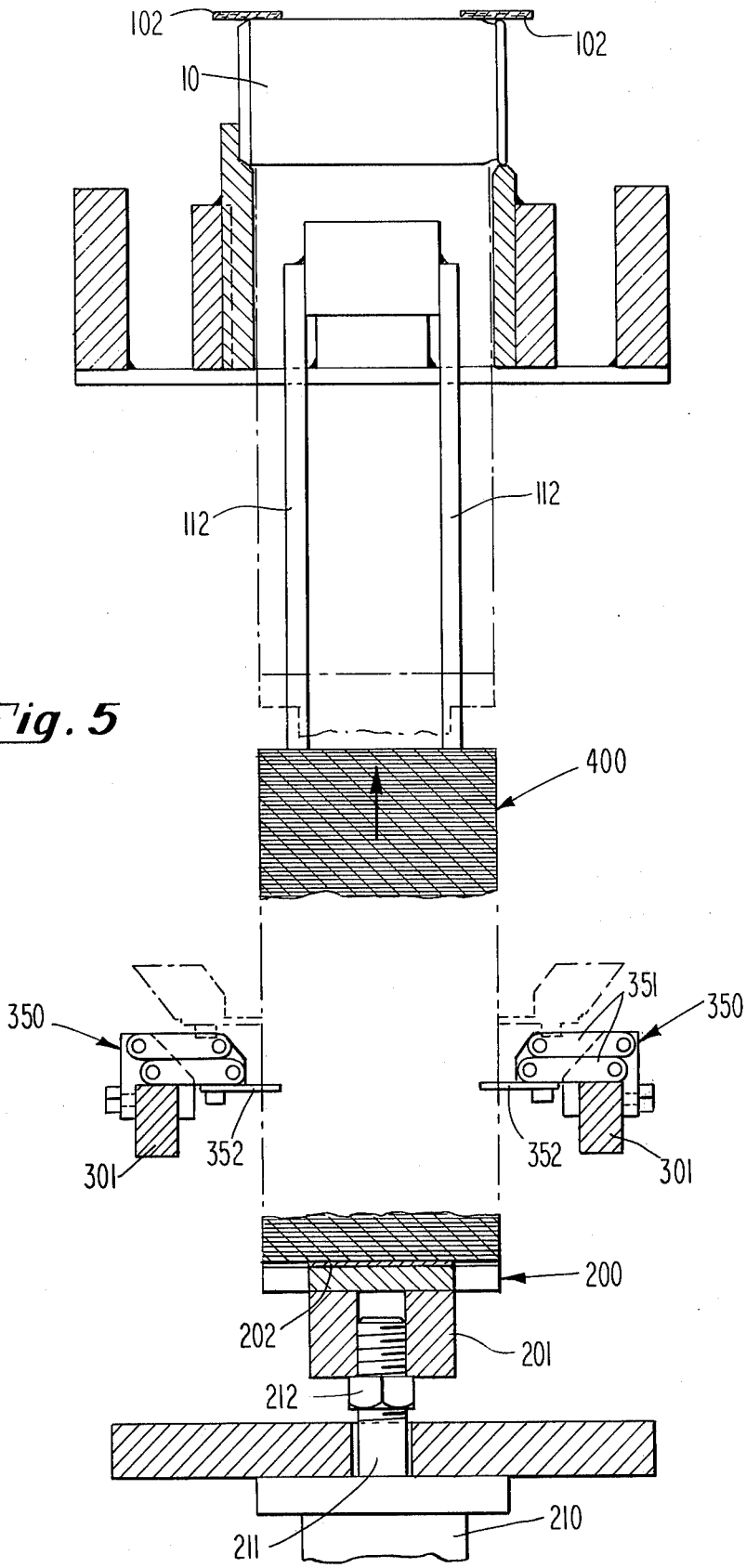
FIG. 5 is a vertical cross-sectional view taken along line V of FIG. 1 showing two positions of the fingers of the secondary table.

FIG. 2 is a top cross-sectional view of the pack feeding mechanism showing primary table 200 and secondary table 300. Labels placed upon primary table 200 are supported by surface 202 (shown in FIG. 3) and are guided by guide rails 112 and 113. Adjustment set screws 230 shown in FIG. 3 are used to adjust the tope face of surface 202 of primary table 200. This adjustment raises or lowers either the pick-up end (front end) or the lap end (rear end) of the label pack to assure proper labeling. The primary table is mounted to and supported by actuator rod 211 which is threaded into table 200 and secured by lock nut 212.

Secondary table 300, as shown in FIG. 2, is comprised of side rails 301, finger assemblies 350, end rails 302 and 303, and acutator attachment assembly 340. As shown in FIG. 2, finger assemblies 350 are in the extended position. The operation of these assemblies will be discussed in detail when discussing FIGS. 6, 7 and 8.

The height of secondary table 300 is controlled by the pneumatic drive 310. As the pneumatic actuator rod 311 is extended vertically, the secondary table assembly moves vertically, supported at one end by rod 111 along which linear bearing assembly 370 moves axially. The other end of the table is supported by actuator rod 311 which is threaded into pivotal attachment plate 340 secured by lock nut 312.

The side rails 301 are pivotally fastened to the attachment plate 340 by shaft assembly 313. The side rails 301 are free to pivot within an arc determined by the position of adjustment screws 330 and adjustment knob 335. Springs 331 bias the side rails 301 so that they are almost parallel to the plate 340 with the end of the shaft 336 of adjustment knob 335 resting upon end rails 302. When an upward vertical force is applied by pneumatic actuator rod 311 to the plate assembly 340, the secondary table is moved vertically upward in reaction to this force. The feeding of the label stack in the magazine is transferred from the primary table 200 to the secondary table 300. Fine adjustment using the adjusting screws 330 and knob 335 position the secondary table in the proper plane to assure a smooth transfer.

The automatic pantograph-type finger assemblies 350 used in conjuction with secondary table assembly 300 can best be understood by reference to FIGS. 6, 7, and 8. FIG. 6 illustrates a stack of labels 400 supported by extended finger assembly arm 352. The finger assembly arm 352 is rotatably attached to side rail 301 by parallel linkage 351. As shown in FIG. 6, finger arm assemblies 352 support the stack of labels 400 when the primary table 200 is withdrawn. After a new supply of labels has been inserted upon the top surface of table 200, primary table 200 is raised until such time as the new labels contact the bottom of the old label stacks supported by fingers 352. When contact has been made between the old and new label stacks the secondary table 300 is then lowered by manually shifting the pneumatic control valve 505 on FIG. 9. As the secondary table drops, as shown in FIG. 7, linkages 351 allow the finger arms assemblies 352 to move out of engagement with label stack 400 while maintaining a horizontal attitude. In FIG. 8, the finger arm assemblies 352 are retracted, at which time the label pack is again supported by primary table 200. It is a novel feature of this invention that this retraction of the finger arm assemblies is accomplished completely, automatically, without any need for separate control linkage. With the finger assemblies 352 retracted to the position shown in FIG. 8 the secondary table assembly 300 is lowered into position ready to repeat the cycle.

Figure 9:
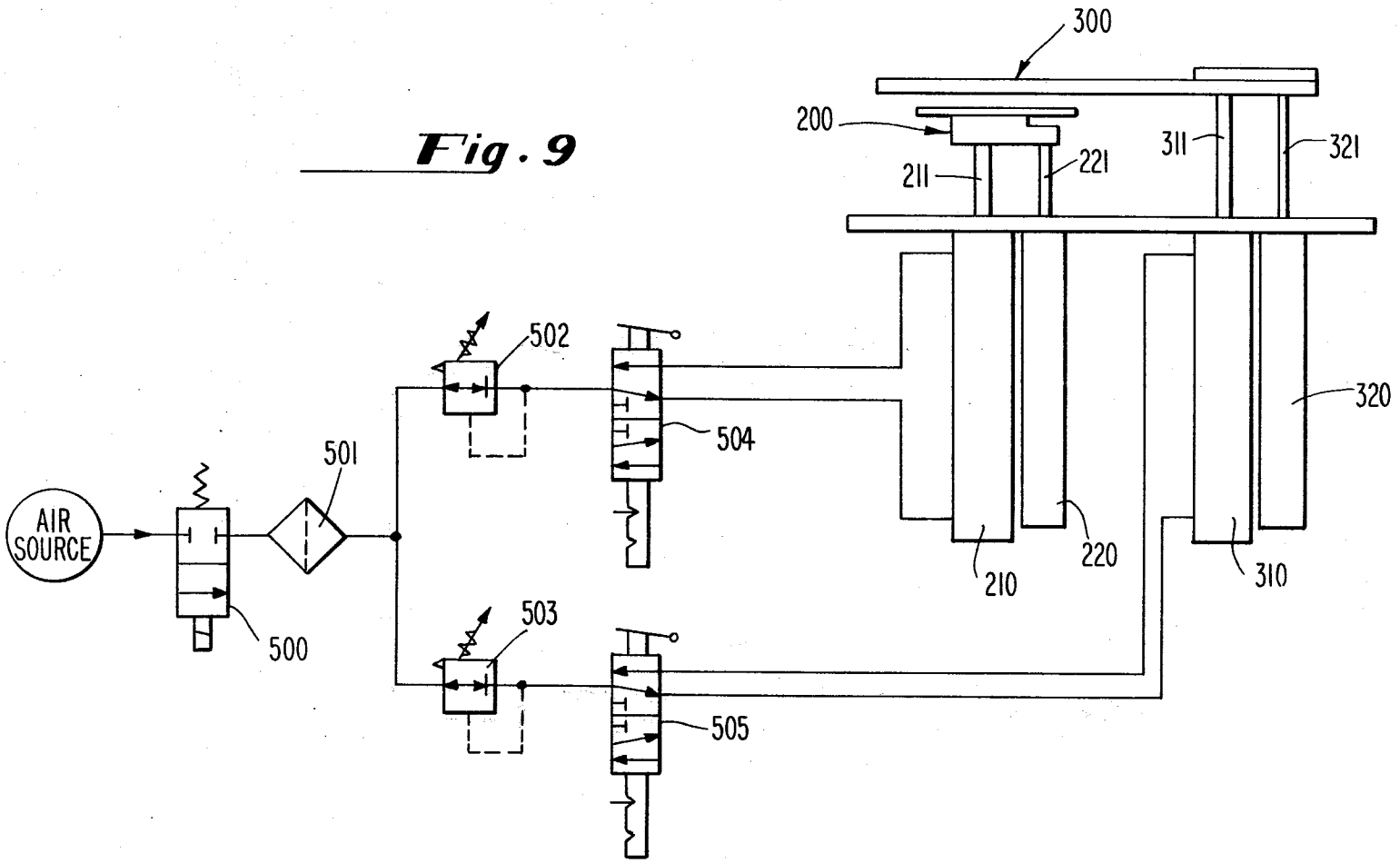
FIG. 9 is a schematic diagram of the pneumatic drive mechanism of the primary and secondary tables.

The operation of the pneumatic drive cycle of the first embodiment is shown in FIG. 9. Line pressure of about 80 psi is applied to off/on valve 500 as shown. Valve 500 is illustrated in the "off" position. The air is then filtered by forty micron filter strainer 501 and applied to two pressure limiting valves 502 and 503. Pressure limiting valve 502 maintains the level of pressure between 18 and 22 psi, while pressure limiting valve 503 maintains the pressure applied to pneumatic valve 505 within the range of 30 to 35 psi. Different pressures are applied to the identical pneumatic actuators of the primary and secondary tables because different forces are necessary to move the tables in a manner which will allow the labels to feed smoothly. Pneumatic lever valves 504 and 505 control raising and lowering the primary and secondary tables respectively, as shown.

In operation, the forces applied by pneumatic drives 210 and 310 to the primary and secondary tables respectively, are damped by operation of the hydraulic dampers 220 and 320. The rods 221 and 321 of hydraulic dampers 220 and 320 are threaded into the primary and secondary tables, respectively, and secured thereto by lock nuts 222 and 322. The hydraulic dampers insure smooth operation of the pneumatic actuators and avoid rapid excursions of the table which might otherwise result.

Figure 10:
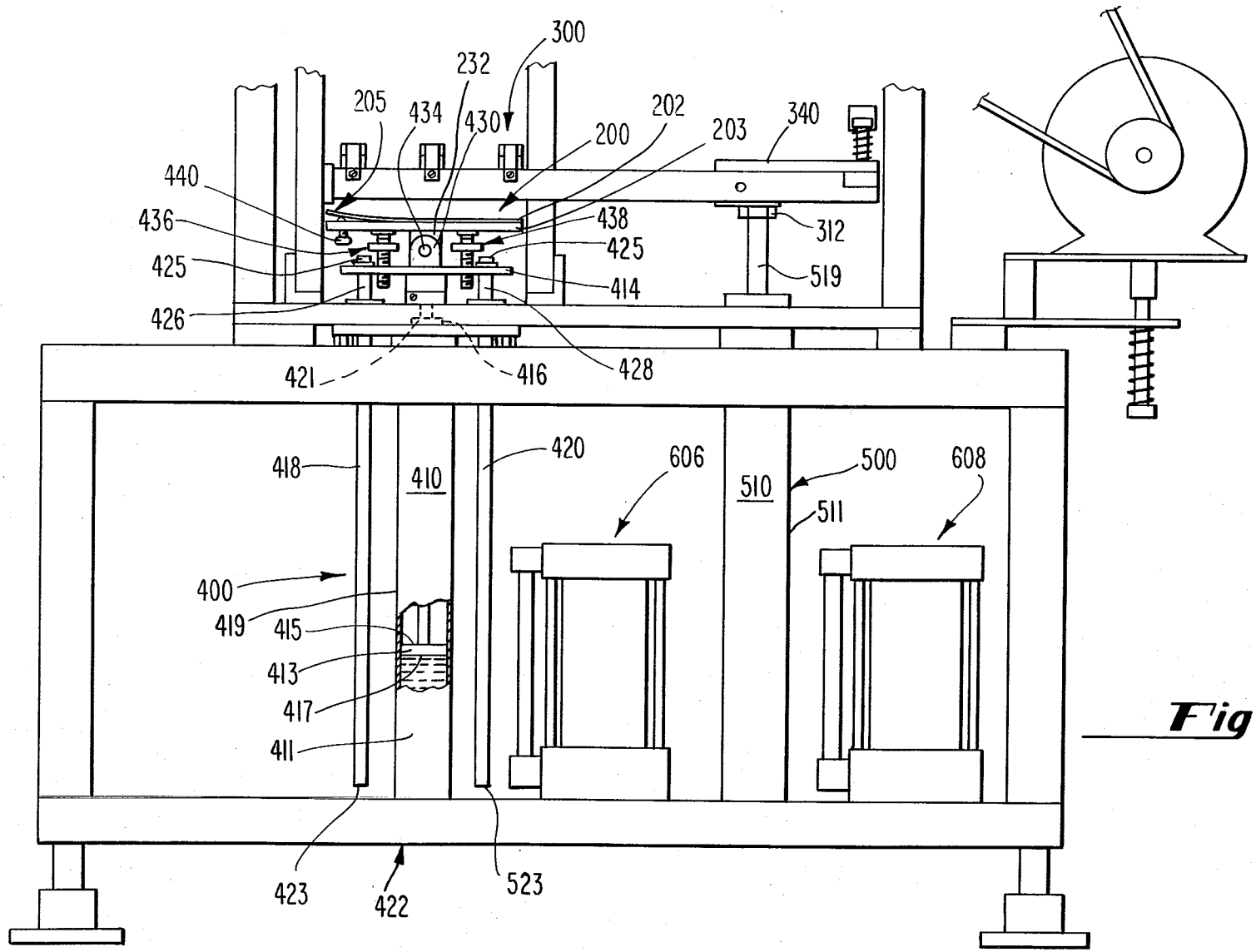
FIG. 10 is a partial elevational view of the preferred embodiment of the present invention.
Figure 11:
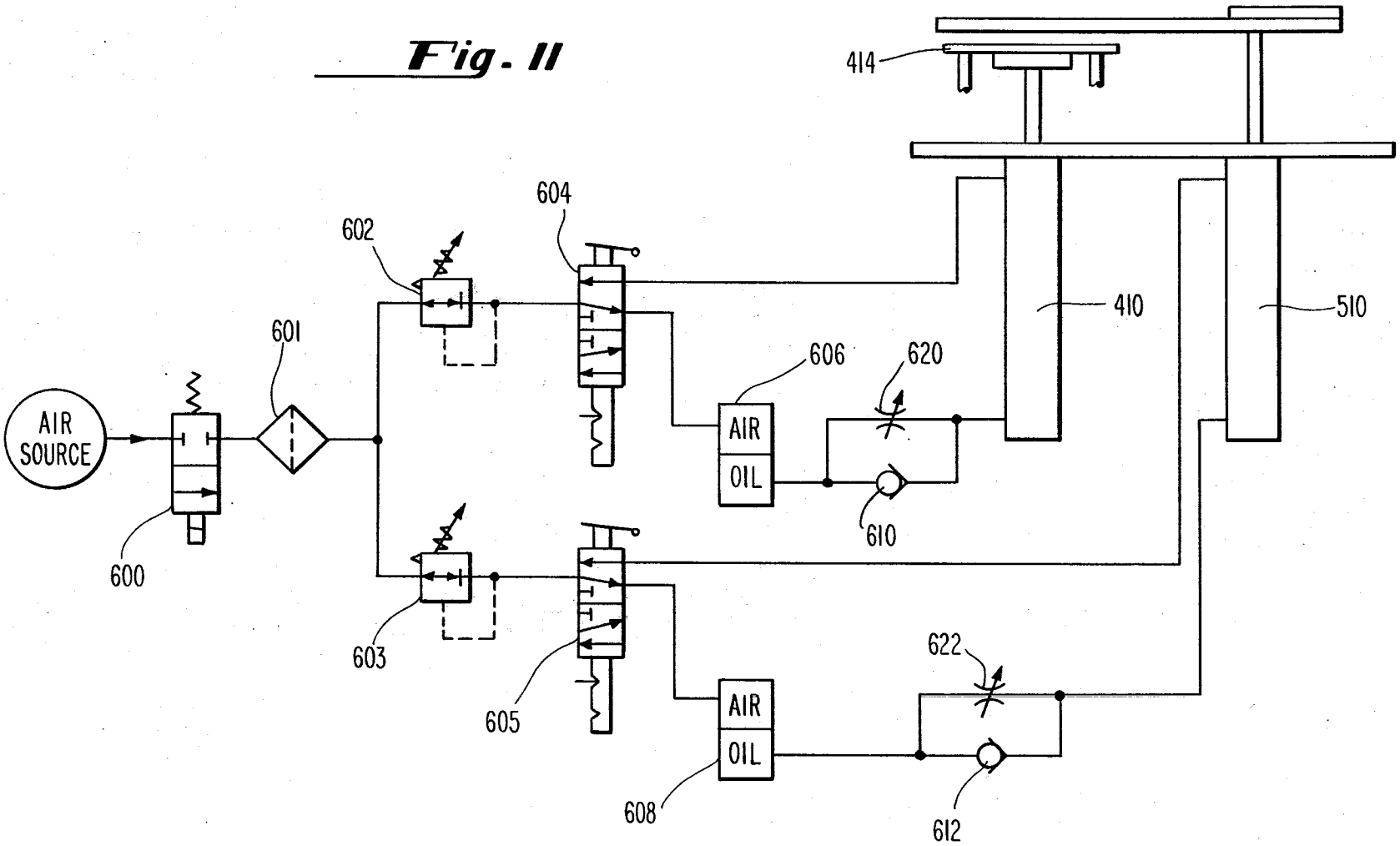
FIG. 11 is a schematic diagram of the fluid drive means for the primary and secondary tables of the preferred embodiments.

The preferred embodiment of the present invention is illustrated in FIGS. 10 and 11. It is to be understood that the preferred embodiment, illustrated in FIG. 10 is a partial elevational view of the embodiment and includes all the components shown in FIG. 1 not specifically included or discussed in reference FIG. 10.

As shown in FIG. 10, the preferred embodiment of the present invention utilizes a hydraulic drive 400 to raise both the primary table 200 and the secondary table 300. The hydraulic drive consists of a hydraulic cylinder 410, which includes a barrel portion 411 and a piston 413 positioned and movable within the barrel portion. The piston has a top 415 and a bottom 417. Rod 419 is secured to the top 415 and extends therefrom. The other end 421 of rod 419 is secured to primary table support 414 by lock nut 416 or by any conventional means. An oil reservoir (supply) 606 is connected to cylinder 410 to communicate oil to the barrel of the cylinder and thereby contact and exert an upward force on bottom 417 of piston 413.

Guide shafts 418 and 420 are positioned on either side of cylinder 410 and pass through aperatures in frame 422 of the labeling machine. The ends 425 of rod 419 pass through apertures, (not shown), contained in support 414. Collars 426 and 428 are mounted to end 425 to secure the guide shafts to the primary table support. Guide shafts 418 and 420 move through the aperatures in the frame as the primary table moves vertically.

Primary table 200 consists of a plate 203 pivotally mounted to support 414 by means of clevises 430 and 432 and pin 434. Thumb screws 436 and 438 are mounted to either side of clevises 430 and 432 and interposed between the support and the bottom of plate 203 of primary table 200. These screws vary the position of the primary table relative to support 414. The plate of the primary table has a top face 202 the front or pick-up end 205 being adjustable, in a vertical plane, by means of screw 440.

The second table illustrated in FIG. 10 is identical to the second talbe described above in reference to FIGS. 1–9. The only difference is that in the preferred embodiment a hydraulic drive 500, controlled and operated by a pneumatic actuator moves the table into label feeding relation. The hydraulic drive of the secondary table is identical to that described above in reference to the hydraulic drive for the primary table. Specifically, the hydraulic drive for the secondary table consists of a hydraulic cylinder 510. The hydraulic cylinder includes a barrel portion 511, a piston, not shown, positioned and movable in the barrel portion having a top and a bottom. A rod 519 is secured to the top of the piston and extending out of and through barrel 511 of the cylinder. The other end of rod 519 is threaded and secured to plate 340 by lock nut 312.

The operation of the pneumatic actuator and hydraulic drive which comprise the fluid drive of the preferred embodiment of the present invention is shown in FIG. 11. Line pressure of approximately 80 psi is applied to on/off valve 600. The air is then filtered by a filter strainer 601 and applied to two pressure limiting valves 602 and 603. Pressure limiting valve 602 maintains the level of pressure between 17 and 22 psi, while valve 603 maintains the pressure applied to pneumatic valve 605 within the range of 28 to 30 psi. Different pressures are applied to the respective lines of the primary and secondary tables because different forces are necessary to move the respective tables in a manner which will allow the labels to feed smoothly. Pneumatic lever valves 604 and 605 control the application of the air pressure either to the oil reservoir supply 606 and 608 to lift the primary and secondary tables, or to the top of the barrel of the hydraulic cylinders to depress the piston contained therein to lower either or both of the tables. It is the flow of air under pressure into the respective oil supplies which causes the oil to pass through oil flow valves 610 and 612 respectively, and enter the lower portion of the barrels of the hydraulic cylinders to exert a steady and constant upward force on the bottom portion of the pistons to raise the respective tables. It is the flow of the oil into the cylinder to raise the tables which provides a smoother ascent for the respective tables than has been previously attainable. To lower the tables, valves 604 and 605 are adjusted so that air under pressure proceeds through the respective pneumatic valves to the top portion of the barrel of the hydraulic cylinder to exert a downward force on the top portion of the pistons to lower the respective tables.

Specifically, the force applied by the air through pneumatic valves 604 and 605 act to "pump" the oil from the oil supply through oil flow valves and into the hydraulic cylinders to raise either or both of the tables. To lower the tables, air, under pressure, is introduced into the top of the hydraulic cylinder thereby exerting a downward lowering force on the top of the piston of the respective cylinders.

The use of the fluid drives discussed above represents a considerable improvement over the prior art mechanical actuators, in that, the constant even force imparted by the use of oil during the ascent of the tables, result in much smoother trouble-free feed operation of the mechanism. Earlier mechanical feeds moved in shorter increments, rather than continuously, resulting in uneven forces being applied to the labels. The change to a linear feed stroke makes it possible to add more precise adjustments, which contributes to the overall effectiveness of this new and novel system. Prior art machines did not contain the fine adjustment features described above because the overall design approach made it impossible to incorporate them.

In the foregoing description, certain terms have been used for brevity, clearness, and understanding, but no unnecessary limitations are to be implied therefrom beyond the requirements of the prior art, because such words are used for descriptive purposes herein, and are intended to be broadly construed.

What is claimed is:

1. A pack feeding mechanism for a labeling machine having a primary and a secondary table for feeding the labels wherein the primary table is normally disposed in feeding relation to the pack and wherein the secondary table is normally disposed out of feeding relation to said pack wherein said secondary table employs retractable fingers to support the labels, when said secondary table is disposed in feeding relation with said pack, wherein the improvement comprises:

a. fluid drive means to raise and lower both said primary and said secondary tables into and out of feeding relation with said pack as required during the operation of said labeling machine, and b. automatic retraction and extension means for moving the fingers of said secondary table to allow said fingers to support said labels when said primary table is disposed out of feeding relation with said pack and to automatically remove said fingers out of engagement with said labels when said primary table is moved into feeding relation with said pack and said secondary table is lowered out of said feeding relation with said pack.

2. A labeling machine comprising:

a. a frame;

b. a conveyor operably associated with the frame for transporting items to be labeled through the labeling machine;

c. adhesive applying means operably associated with the conveyor for applying adhesive to said items to be labeled;

d. a pack of labels;

e. a primary table movably mounted to said frame and normally disposed in feeding relation to said pack of labels for supplying and affixing said labels to said items to be labeled after said items to be labeled have passed through said adhesive applying means.

f. a secondary table operably associated with said primary table movably mounted to said frame and normally disposed out of feeding relation to said pack of labels comprising retractable fingers for engaging, retaining and supplying said pack of labels contained on said primary table when said primary table is disposed out of feeding relation with said pack of said labels;

g. automatic retraction and extension means for moving the fingers of said secondary table to allow said fingers to support said pack of said labels when said primary table is disposed out of feeding relation with said pack of said labels and to automatically remove said fingers out of engagement with said pack of said labels when said primary table is moved into feeding relation with said pack of said labels and said secondary table is lowered out of said feeding relation with said pack of said labels; and h. fluid drive means to raise and lower both said primary and secondary tables into and out of feeding relation with said pack of said labels as required during the operation of said labeling machine.

3. A pack feeding mechanism for a labeling machine comprised of a primary and a secondary table for feeding the labels wherein the primary table is normally disposed in feeding relation to the pack and wherein the secondary table is normally out of feeding relation to the pack wherein the secondary table employs retractable fingers to support the labels and wherein the improvement comprises:

a. pneumatic actuator means to move the primary and secondary tables into and out of feeding position as required during operation of the labeling machine;

b. hydraulic damper means between the primary table and the frame of the labeling machine and between the secondary table and the frame of the labeling machine;

c. automatic retraction and extension means for moving the fingers of the secondary table to allow the fingers to support the labels when the primary table is disposed out of feeding position and to automatically pivot the fingers out of engagement with the labels when the primary table is moved into feeding position, and the secondary table lowered.

4. The apparatus according to claim 3 wherein the automatic retraction and extension means comprise two parallel links disposed on each side of each finger rotationally connecting the fingers to the secondary table, whereby the fingers are maintained in a horizontal position and moved horizontally out of engagement with the label stack when the labels are urged vertically upward by the primary table.

5. The apparatus according to claim 4, wherein the pneumatic actuator means comprises:

a. A first pneumatic actuator disposed between the primary table and the frame of the labeling machine;

b. a second pneumatic actuator disposed between the secondary table and the frame of the labeling machine;

c. a primary air pressure supply source;

d. a first pneumatic valve to communicate air pressure to the first pneumatic actuator;

e. a second pneumatic valve to communicate air pressure to the second pneumatic actuator.

6. The apparatus according to claim 5, wherein one end of the second pneumatic actuator and one end of the secondary table hydraulic damper means are secured to an attachment plate, said attachment plate being pivotally connected to the secondary table, said attachment plate having adjustment means to vary the planar relationship of the plate and the secondary table to assure a smooth transfer of labels.

* * * * *